US009951490B2

(12) United States Patent
Scherkl

(10) Patent No.: US 9,951,490 B2
(45) Date of Patent: Apr. 24, 2018

(54) BLOCK, FLOOD PROTECTION BARRIER AND A METHOD FOR PRODUCING A BARRIER OF THIS TYPE

(71) Applicant: RESCO Consulting GmbH, Unterpremstaetten (AT)

(72) Inventor: Helmut Scherkl, Pistorf (DE)

(73) Assignee: RESCO Consulting GmbH, Unterpremstaetten (AT)

( * ) Notice: Subject to any disclaimer, the term of this patent is extended or adjusted under 35 U.S.C. 154(b) by 131 days.

(21) Appl. No.: 14/889,620

(22) PCT Filed: Apr. 23, 2014

(86) PCT No.: PCT/AT2014/050102

§ 371 (c)(1),
(2) Date: Nov. 6, 2015

(87) PCT Pub. No.: WO2014/179823

PCT Pub. Date: Nov. 13, 2014

(65) Prior Publication Data

US 2016/0090705 A1 Mar. 31, 2016

(30) Foreign Application Priority Data

May 6, 2013 (AT) ..... 50308/2013

(51) Int. Cl.
*E02B 3/10* (2006.01)
*E02B 3/14* (2006.01)
(Continued)

(52) U.S. Cl.
CPC ..... *E02B 3/10* (2013.01); *E02B 3/106* (2013.01); *E02B 3/14* (2013.01); *E02B 7/10* (2013.01);
(Continued)

(58) Field of Classification Search
CPC ..... E02B 3/14; E04C 1/00
See application file for complete search history.

(56) References Cited

U.S. PATENT DOCUMENTS 2,392,551 A 5/1943 Roe
6,578,338 B1 * 6/2003 Nanayakkara ..... E04B 2/14 52/603
(Continued)

FOREIGN PATENT DOCUMENTS

DE 87 15 879 U1 5/1988
DE 197 45 941 A1 5/1999
(Continued)

*Primary Examiner* — John Kreck
(74) *Attorney, Agent, or Firm* — Muncy, Geissler, Olds & Lowe, P.C.

(57) ABSTRACT

The invention relates to a stone, in particular a dam stone for a flood dam. In order to be able to build a stable flood dam in an easy way, according to the invention a cover surface is provided with at least two ribs and an opposing base surface is provided with at least two grooves corresponding to the ribs so as to create an indirect connection between two stones by means of a third stone that can be detached by applying a tensile force perpendicular to the base surface. The invention further relates to the use of such a stone. In addition, the invention relates to a method for manufacturing a mass retention structure, in particular a flood dam.

14 Claims, 3 Drawing Sheets

Figure 1:
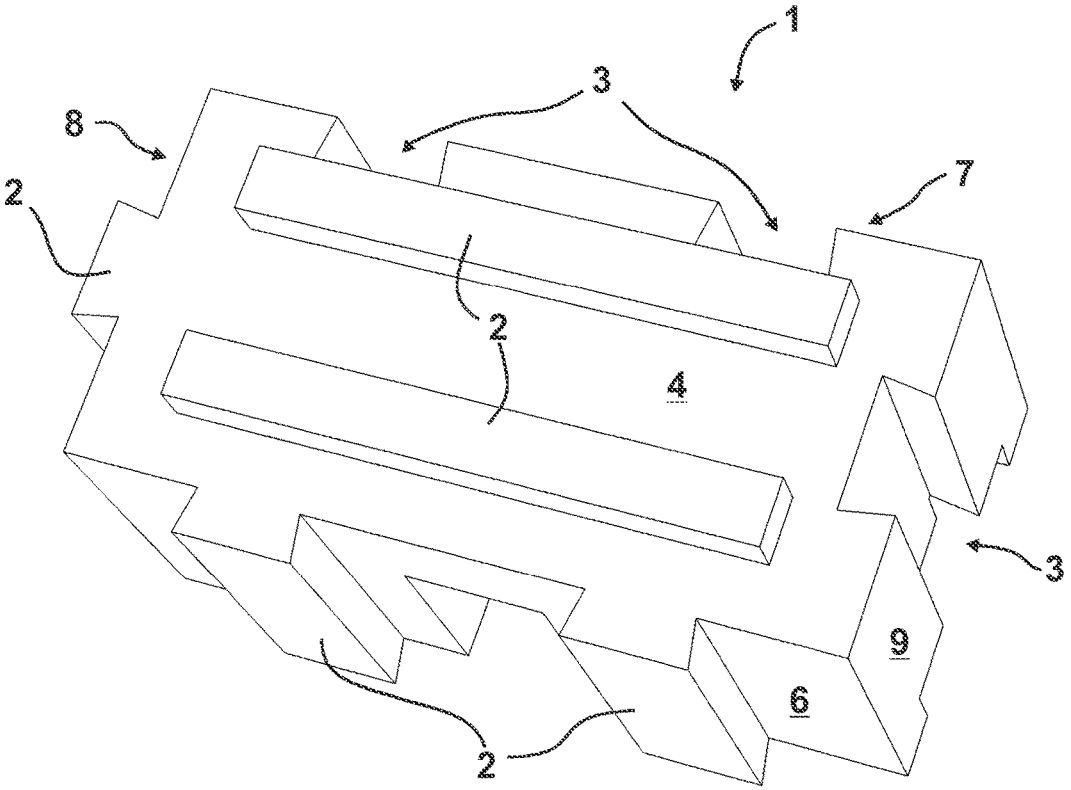
Figure 2:
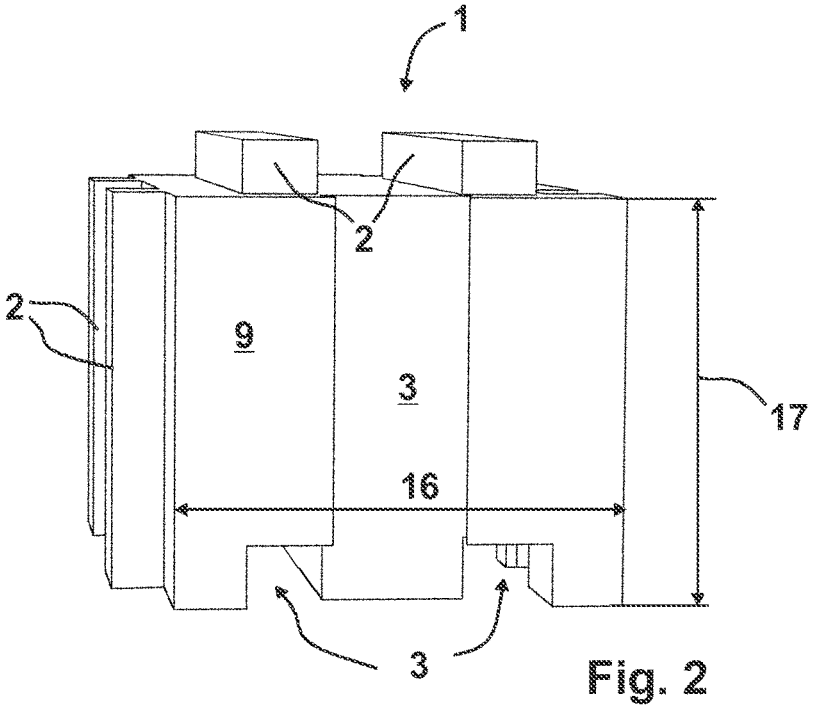

(51) Int. Cl.

| | |
|---|---|
| ***E04B 2/08*** | (2006.01) |
| ***E04C 1/39*** | (2006.01) |
| ***E02B 7/10*** | (2006.01) |
| ***E04C 1/00*** | (2006.01) |
| *E04B 2/02* | (2006.01) |

(52) U.S. Cl.
CPC ..... *E04B 2/08* (2013.01); *E04C 1/00* (2013.01); *E04C 1/395* (2013.01); *E04B 2002/0206* (2013.01); *E04B 2002/0228* (2013.01); *E04B 2002/0234* (2013.01)

(56) References Cited

U.S. PATENT DOCUMENTS

| | | | | |
|---|---|---|---|---|
| 8,074,419 | B1 * | 12/2011 | Humphress | E04B 2/46 446/120 |
| 8,882,398 | B2 * | 11/2014 | Bender | E02D 29/025 405/284 |
| 9,453,341 | B1 * | 9/2016 | Swierad | E04C 1/395 |
| 2010/0058677 | A1 * | 3/2010 | Arteon | E04G 21/142 52/122.1 |

FOREIGN PATENT DOCUMENTS

| | | | |
|---|---|---|---|
| DE | 20 2004 014 358 | U1 | 2/2006 |
| FR | 2 729 684 | A1 | 7/1996 |
| GB | 09474 | | 6/1916 |
| GB | 1 388 117 | A | 3/1975 |

* cited by examiner

BLOCK, FLOOD PROTECTION BARRIER AND A METHOD FOR PRODUCING A BARRIER OF THIS TYPE

This application is a national stage of International Application No.: PCT/AT2014/050102, which was filed on Apr. 23, 2014, and which claims priority to Austrian Patent Application No.: A 50308/2013, which was filed in Austria on May 6, 2013, and which are both herein incorporated by reference.

The invention relates to a stone, in particular a dam stone for a flood dam.

The invention further relates to the use of such a stone.

In addition, the invention relates to a method for manufacturing a mass retention structure, in particular a flood dam.

At the present time, sandbags either filled on site or transported already filled to a location threatened by flooding are used to protect against flood damage or debris accumulation. Sandbags allow even untrained individuals to build up flood protection by stacking the latter one on top of the other. However, the disadvantages to flood dams formed in this way is that they only exhibit a limited strength in a horizontal direction. In order to still create a stable flood dam, the sandbags are thus arranged in several rows one in back of the other, making it very complicated to manufacture a stable dam. In addition, the sandbags most often first have to be filled with sand, so that such a flood dam can only be built in a time-consuming process. Likewise, because the construction method preferably involves no binding agents, a lot of exertion and time is associated with dismantling the flood dam, during which the sandbags must again be emptied and stowed away.

Known from DE 197 45 941 A1 are stones for building an interlocking stone system, wherein individual stones are interlocked without mortar or adhesive by means of dovetailing elements. However, such an interlocking stone system has proven disadvantageous for building a flood dam owing to a low strength in particular in the horizontal direction and a high manufacturing expense.

Further known from DE 87 15 879 U1 are bricks, which exhibit dovetailing projections on their rear side. On the one hand, the disadvantage to using the latter in a flood dam is that additional anchor stones are needed for a stable structure. On the other hand, they do not permit the manufacture of a flood dam having a high strength and large width.

Therefore, the object of the invention is to indicate a stone with which a flood dam having a high strength can be easily erected and dismantled.

A use for such a stone is also to be specified.

Furthermore, a method for easily manufacturing a flood dam having a high strength is to be indicated.

The first object is achieved according to the invention by a stone of the kind mentioned at the outset, wherein a cover surface is provided with at least two ribs, and an opposing base surface is provided with at least two grooves corresponding to the ribs so as to create an indirect connection between two stones by means of a third stone that can be detached by applying a tensile force perpendicular to the base surface.

Because the ribs correspond to the grooves, a stone according to the invention can be used to very easily build a stable flood dam consisting of interlocking, identical stones. On the one hand, stones can here be stacked directly on top of each other without any displacement, wherein an interlocking connection between the ribs and grooves also enables the transfer of transverse forces. On the other hand, the stone according to the invention also makes it possible to indirectly interlock two adjacently positioned stones by means of a third stone situated on these stones. The joining stone is here displaced relative to the underlying stones, so that a rib engages into one of the two grooves of the overlying stone to interlock each of the underlying stones. This makes it possible to build a flood dam with several joined stones lying one behind the other or side by side, which exhibits a high strength even in the horizontal direction.

Designing the ribs and grooves for a bond that can be detached by exposure to a tensile force perpendicular to the base surface yields a simple way to manufacture the flood dam, since the individual stones can be assembled and disassembled just like conventional bricks in a wall by what is usually a vertical movement perpendicular to the base surface. Since the ribs need not be introduced along the extension of the grooves to join several stones together, a flood dam becomes easy to build even when the ribs or grooves are aligned along a longitudinal axis or along a length of the stone, which yields an especially high stability. Instead of a dovetailing cross section, the ribs of the cover surface and/or grooves of the base surface to this end normally exhibit a cross section with bordering surfaces that are parallel or taper with increasing distance from the cover surface or base surface.

An especially high strength in a horizontal direction is obtained if the ribs situated on the cover surface and/or grooves provided on the base surface essentially exhibit a rectangular cross section.

By comparison to a flood dam comprised of sandbags, this permits the erection of a stable, watertight flood dam with a lower dam width, which can also be quickly dismantled after use. After used, the stones can be cleaned and stowed away for a future use, so that they can be utilized as often as desired. This also reduces the costs of manufacturing a flood dam.

To ensure a particularly high stability for the flood dam while keeping costs low, it has also proven very beneficial for the stone to be made out of concrete. Of course, alternative materials able to withstand the corresponding loads are also possible.

Despite the positive fit, the preferably parallel ribs and grooves require that the stacked stones be precisely positioned only in a direction perpendicular to the ribs, allowing even untrained assistants to easily build the flood dam, since the stones latch into each other. It is here advantageous for the ribs and grooves to be straight, so that stones positioned one over the other can later be shifted in the direction of the ribs or grooves. Ribs situated on a cover surface of the stone and corresponding grooves on the bottom are usually designed with a rectangular cross section along a longitudinal axis of the stone, so that the flood dam can be very easily built in several layers by stacking the stones.

In order to be able to build a particularly massive and resistant flood dam, it makes sense for the distance between the middle of the ribs to measure roughly twice the edge distance from the middle of a rib to the edge of the stone. This makes it possible to join two flush, adjacent stones with an identical stone situated on the two stones, without cavities arising in the flood dam in the process.

Since straight ribs and grooves permit a fixation in just one direction perpendicular to the rib, it is advantageous in order to join stones in a stable manner in several spatial directions that there be at least two ribs on a first lateral surface and grooves corresponding to these ribs on a second lateral surface lying opposite the first lateral surface. This allows a high strength for the dam in several directions given a low width or mass of the dam.

The stone preferably has essentially a square shape, wherein a corner joint is created by providing ribs on at least two sides and corresponding grooves on at least two other sides. A corner joint enables the realization of flood dams with a wide range of shapes. It is here especially beneficial if the stone exhibits a length to width ratio of about two, so that two longitudinally adjacent stones can be joined together by a stone positioned transverse thereto. The length and width are here defined as distances between the lateral surfaces without ribs. To this end, a centrally located rib or groove is normally provided on a broad side of the stone, and two grooves or ribs are provided on a long side, with the ratio between rib distance and edge distance measuring about two. A simple bond between a broad side of a stone with a long side of another stone is achieved when the longitudinal axes of the ribs or grooves of the broad side and longitudinal side are aligned roughly parallel to each other, and the ribs exhibit an identical cross section. The lateral surfaces of the stone along with the cover surface and base surface exhibited by the ribs or grooves are preferably designed as flat surfaces so that the stones can be easily joined together.

It is best that the ribs and grooves be designed at least in part for a bond exposable to a tensile force, in particular for a dovetailed joint, so as to achieve a good stability for the flood dam. While a dovetailed joint has proven itself based on ease of manufacture, other shapes are possible for the ribs and grooves that allow a positive-fit connection exposable to a tensile force. A distance between the bordering surfaces of the cross section here usually increases as does the distance from the lateral surface, for example semicircular, triangular and/or polygonal cross sections.

To ensure that stones stacked on top of each other can be displaced, it makes sense for at least one rib to be shorter than a groove corresponding to the rib and lying on an opposing lateral surface of the stone. Usually, the rib then does not extend over an entire length of the corresponding lateral surface, creating gaps between the rib ends and edges of the stone. As a result, a stone can also be positioned offset on a stone or corner joint, without colliding with the ribs of the additional stone of the corner joint. This type of configuration enables a wide variety of shapes for the flood dam, thus yielding a high flexibility during the manufacturing process.

With respect to assembly, it is advantageous for an additional recess to be provided as the assembly grip on a lateral surface of the stone in roughly the middle. In this way, the stone can also be moved with one hand, thereby making it easier to erect and dismantle the flood dam.

Of course, a stone according to the invention can also be used in another orientation, so that the individual lateral surfaces can be switched with the base surface or cover surface.

In order to have a high-strength flood dam that is especially easy to manufacture, it is advantageous for the flood dam to exhibit stones according to the invention that are joined together by identical stones in the vertical and horizontal direction. Ribs and corresponding grooves normally situated on all sides of the stone make it easy to achieve a connection on all sides. This type of flood dam can be fabricated with little effort by stacking or vertically inserting the stones, and preferably exhibits several positive-fit connections, wherein stones can be joined together atop, next to, and parallel to each other, or take the form of a corner joint.

The second object of the invention is achieved by using a stone according to the invention to build a flood dam. This makes it possible to put the advantages described above into practice especially well.

It has also proven favorable to use a stone according to the invention to fortify an embankment. Several stones are usually interlocked for this purpose, in particular in several spatial directions, making it possible to easily and effectively fortify the loose mass comprising the embankment, normally soil or gravel.

The additional object is achieved according to the invention in a method of the kind mentioned at the outset by indirectly joining two stones that exhibit ribs and grooves corresponding to the ribs, in particular stones designed as per the invention, using a third such stone. This yields a mass retention structure, in particular a high-strength flood dam, with simple means. At the same time, such a structure can be quickly erected, expanded and also dismantled again after use given its modular design. The structure can also be used to fortify an embankment or the like.

Figure 5:
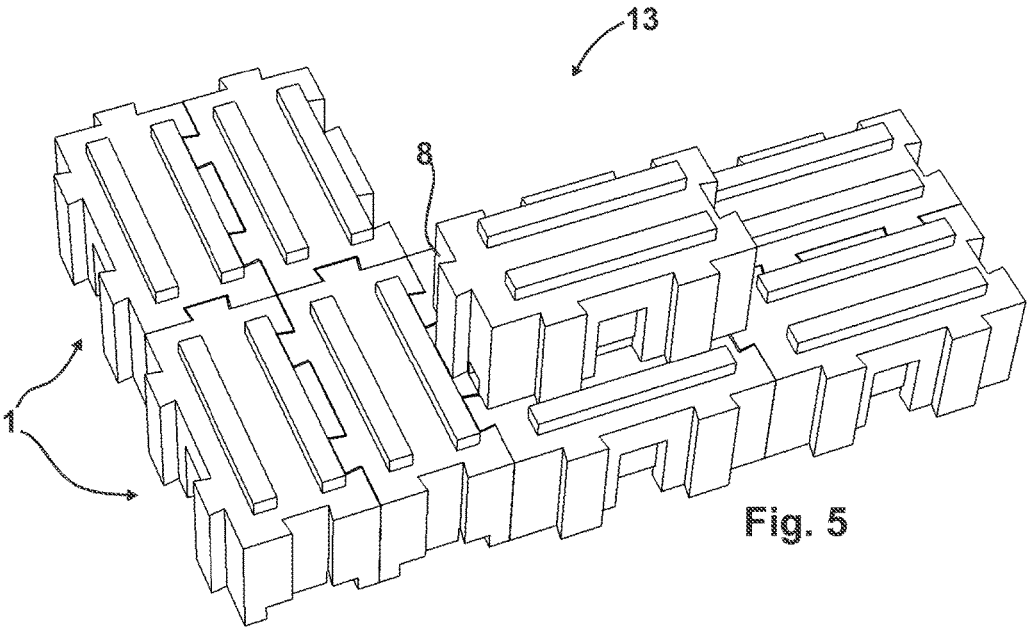
Figure 6:
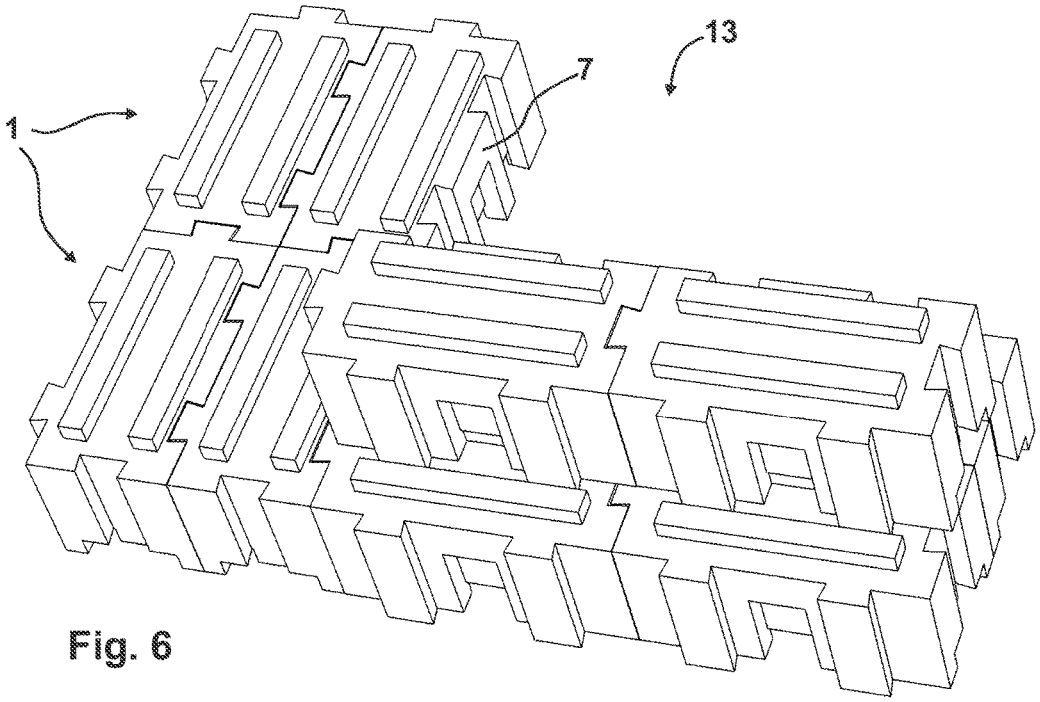

Additional features, advantages and effects of the invention may be gleaned from the exemplary embodiments depicted below. Shown on the drawings to be referenced here is:

FIGS. 1 to 4 a possible embodiment of a stone according to the invention in various isometric views;

FIGS. 5 and 6 parts of a flood dam.

FIGS. 1 to 4 present various isometric views depicting a stone 1 according to the invention designed as a dam stone, wherein a cover surface 4 is clearly provided with two parallel ribs 2 that exhibit a rectangular cross section.

More than two ribs 2 can basically also be provided. Grooves 3 that correspond to the ribs 2 and also exhibit a rectangular cross section are provided on a base surface 5 lying opposite the cover surface 4. The ribs 2 and grooves 3 provided in the cover surface 4 and base surface 5 make it possible to join two adjacent stones 1 by a third stone 1 situated on top of these stones 1 in an indirect and interlocking manner.

Further provided on a first lateral surface 6 and a third lateral surface 8 are ribs 2, which extend along a height 17 of the stone 1. These ribs 2 are provided with corresponding grooves 3 on the second lateral surface 7 and fourth lateral surface 9. A gap between two rib centers 13 on a lateral surface is defined as the rib distance 10, while a gap between a rib center 13 and an edge of the stone 1 is defined as the edge distance 11.

It is beneficial for the ratio between the rib distance 10 and edge distance 11 to measure about two on both the cover surface 4 and on the first lateral surface 6, so as to build a flood dam 14 with a high strength. On the one hand, having the appropriate ratios allows adjacent stones 1 to be joined together by a third such stone 1 positioned centrally thereupon, since the two grooves 3 of the then overlying stone 1 each correspond with a rib 2 of the two underlying stones 1. On the other hand, stones 1 arranged one behind the other can also be interlocked with a high strength by means of a stone 1 lying next to them.

The third lateral surface 8 has centrally situated upon it a rib 2, which just as the ribs 2 positioned on the first lateral surface 6 extends along a height 17 of the stone 1, so that longitudinal axes of these ribs 2 are parallel. Because these ribs 2 along with the corresponding grooves 3 exhibit the same cross section on the second lateral surface 7 and the fourth lateral surface 9, a positive-fit corner joint can be established between two stones 1. This enables a variety of shapes for a flood dam 14 built using the stones 1. An especially high strength results if the ratio between a width 16 of the stone 1 and a length 15 of the stone 1 measures about two. As depicted, a height 17 of the stone 1 preferably measures between half and twice the width 16 of the stone 1, so as to ensure good operability.

Figure 3:
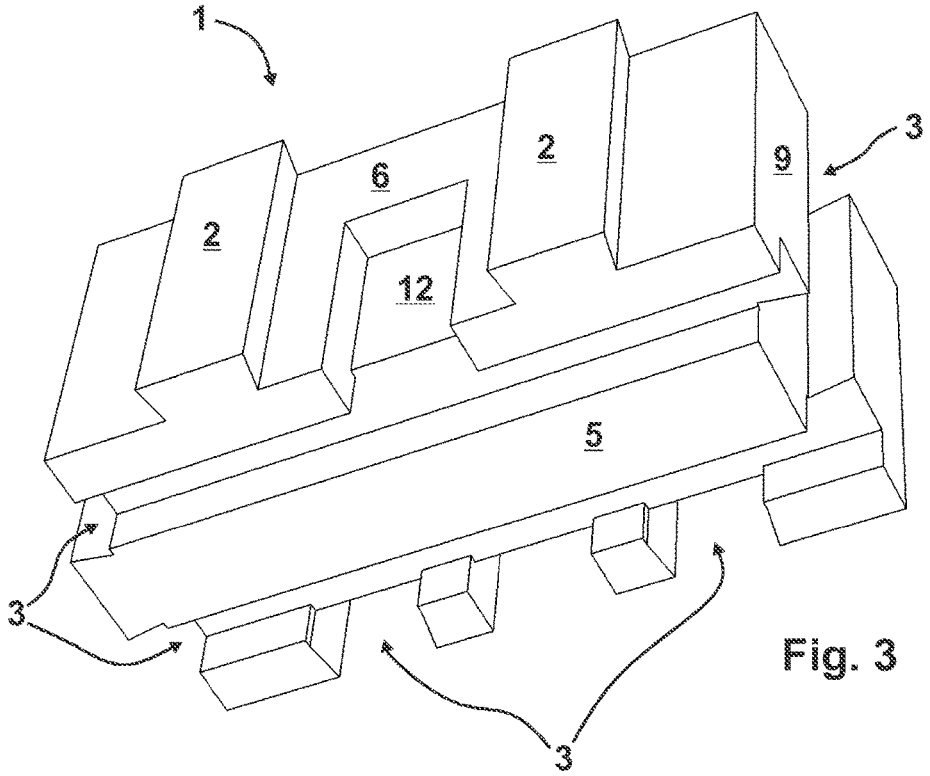
Figure 4:
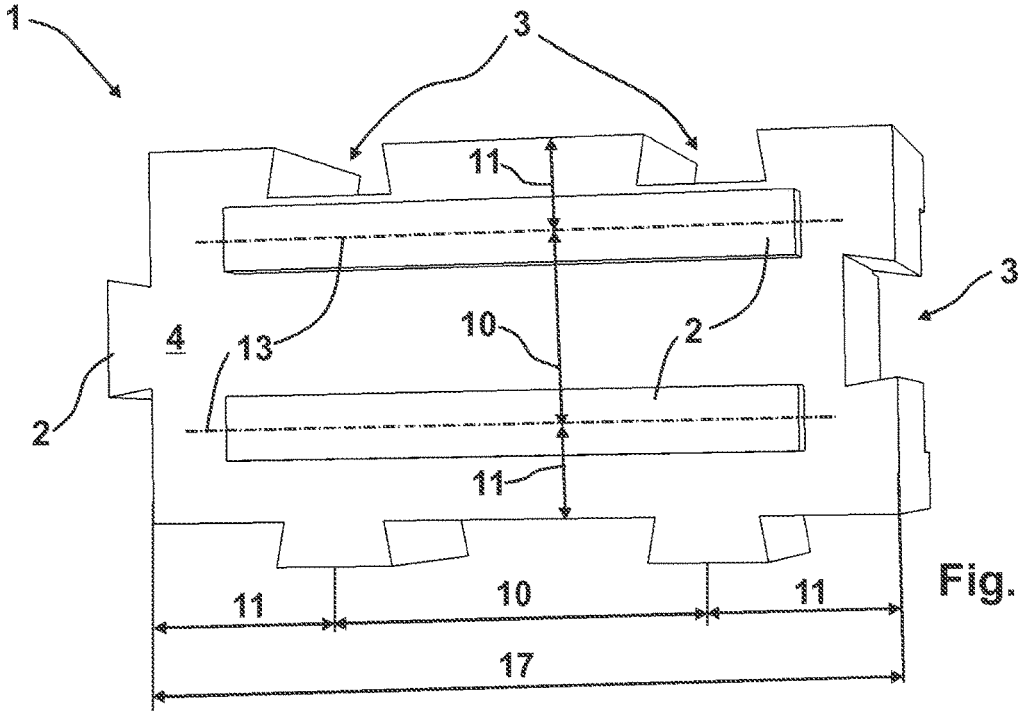

As shown on FIGS. 1 and 3, the ribs on the cover surface 4 are shorter than the corresponding grooves 3 on the base surface 5, and do not extend up to the edges of the cover surface 4. As a result, stones 1 lying one on top of the other can be displaced, facilitating the assembly of the flood dam 14. In addition, it is also favorable for all grooves 3 to extend over the entire length 15 or height 17 of the respective lateral surface.

As further evident, the ribs 2 on the first lateral surface 6 and third lateral surface 8 along with the grooves 3 corresponding thereto exhibit a dovetailing cross section. As a result, the stones 1 can be joined so as to be exposable to tensile stress in any horizontal direction, so that a particularly stable flood dam 14 can be built.

By contrast, in order to easily manufacture a flood dam 14 with several overlying stones 1, it is advantageous for the ribs 2 or grooves 3 of the cover surface 4 and base surface 5 not to yield a bond that can be exposed to a tensile stress, so that the stones 1 in an upper layer can be easily removed from an underlying layer when disassembling the flood dam 14. For a bond in the vertical direction, the corresponding ribs 2 or grooves 3 are usually designed with boundary surfaces that run parallel or taper given an increasing distance from the cover surface 4 or base surface 5, e.g., with a rectangular cross section.

As may be gleaned in particular from FIG. 3, a longitudinal side of the stone 1 according to the invention exhibits an assembly grip 12 designed as a recess, which can be used to easily handle the stone 1. The stone 1 clearly exhibits an essentially square shape, so that the cover surface 4 and base surface 5 are usually perpendicular to a first lateral surface 6, second lateral surface 7, third lateral surface 8 and fourth lateral surface 9. In addition, the first lateral surface 6 and second lateral surface 7 are usually perpendicular to the third lateral surface 8 and fourth lateral surface 9.

FIGS. 5 and 6 present stages in the construction of a structure designed as a flood dam 14, which consists of stones 1 according to the invention. The structure can also be used to fortify other loose masses, for example to fortify an embankment. The illustrated portion of the flood dam 14 exhibits several positively interlocking identical stones 1. Eight stones 1 are depicted in the lower position, wherein a respective four stones 1 are joined together with a parallel and flush orientation. The flood dam 14 further exhibits two corner joints, wherein two side-by-side, parallel stones 1 on a broad side or the third lateral surface 8 are joined with a stone 1 arranged transversely thereto on a long side or the second lateral surface 7. Because the ratio between the rib distance 10 and edge distance 11 measures about two, a bond without a cavity can here be created, thereby yielding a high-strength flood dam 14 without any binding agents.

Also evident is another stone 1 lying on the lower layer, which halfway overlaps two stones 1 of the lower layer with which it is joined. The ribs 2 situated on cover surfaces 4 of the underlying stones 1 here engage into the grooves 3, which are positioned in the base surface 5 of the overlying stone 1. On the one hand, this creates an indirect bond between the underlying stones 1. On the other hand, this yields a food dam 14 with several layers, wherein the individual layers are interlocked, and hence can be exposed to transverse forces.

FIG. 6 depicts the flood dam 14 according to FIG. 5 in another stage of expansion. As evident, the upper layer incorporates a second stone 1, which also indirectly joins two underlying stones, and is bonded with the other stone 1 in the upper layer on a third lateral surface 8 by a dovetailed joint.

The stone 1 according to the invention can be easily used to build a mass retention structure, such as a flood dam 14 with a high strength, which can also be quickly erected by untrained individuals. The special shape and arrangement of the ribs 2 ensures a high strength, because the bond can also be horizontally stressed and exposed to tensile force, as opposed to conventional flood dams 14 comprised of sandbags. As a consequence, the flood dam 14 built with the stone 1 according to the invention can be quickly fabricated, and its modular configuration also allows it to be erected on roadways and bicycle paths, as well as on meadows and fields. It is further possible to modularly expand the flood dam 14 in any direction. Aside from a flood dam 14, the stone 1 according to the invention can of course also be used to easily build a high-strength wall or enclosure, for example to fortify an embankment. Since the stones 1 are only positively joined without a binding agent, the flood dam 14 can also be easily dismantled after use, and the stones 1 can be utilized as often as desired.

The invention claimed is:

1. A stone, in particular a dam stone for a flood dam, the stone comprising:

a cover surface;

at least two elongate, parallel ribs extending longitudinally across the cover surface;

a base surface opposing the cover surface; and at least two elongate, parallel grooves extending longitudinally across the base surface and corresponding to the at least two elongate, parallel ribs so as to create an indirect connection between two stones by a third stone that can be detached by applying a tensile force perpendicular to the base surface, wherein a ratio of a rib distance, which is a distance between a center of the at least two elongate, parallel ribs, to an edge distance, which is a distance between the center of one of the at least two elongate, parallel ribs and an edge of the stone, is 2:1.

2. The stone according to claim 1, wherein the at least two elongate, parallel ribs and the at least two elongate, parallel grooves have a rectangular cross section.

3. The stone according to claim 1, further comprising:

a first lateral surface with at least two lateral ribs disposed on the first lateral surface; and a second lateral surface, opposite the first lateral surface, with lateral grooves, corresponding to the at least two lateral ribs, disposed on the second lateral surface.

4. The stone according to claim 1, wherein the stone is essentially rectangular shaped, and wherein a corner joint is created by providing ribs on at least two sides and corresponding grooves on at least two other sides.

5. The stone according to claim 1, wherein the at least two elongate, parallel ribs are shorter than the at least two elongate, parallel grooves.

6. The stone according to claim 1, further comprising a recess in a central area of a lateral surface of the stone for purposes of assembly.

7. A flood dam, comprising a plurality of stones according to claim 1, which are joined in a vertical and horizontal direction.

8. A method for manufacturing a mass retention structure, the method comprising:

indirectly joining at least two stones according to claim 1 a third such stone.

9. A stone, comprising:

a cover surface;

a base surface opposing the cover surface;

two opposing lateral ends;

two opposing side surfaces disposed between the two opposing lateral ends;

at least two elongate, parallel ribs extending longitudinally across the cover surface; and at least two elongate, parallel grooves extending longitudinally across the base surface and corresponding to the at least two elongate, parallel ribs, wherein a ratio of a rib distance, which is a distance between a center of the at least two elongate, parallel ribs, to an edge distance, which is a distance between the center of one of the at least two elongate, parallel ribs and an edge of the stone, is 2:1.

10. The stone according to claim 9, wherein the at least two elongate, parallel ribs are shorter than the at least two elongate, parallel grooves.

11. The stone according to claim 10, wherein the at least two elongate, parallel grooves extend along an entirety of the base surface.

12. The stone according to claim 9, further comprising:

a lateral end rib disposed on a first of the two opposing lateral ends; and a lateral end groove disposed on a second of the two opposing lateral ends, wherein the lateral end rib and the lateral end groove each have a dovetailing cross section.

13. The stone according to claim 9, further comprising an assembly grip disposed on the two opposing side surfaces.

14. The stone according to claim 13, wherein the assembly grip comprises a recess formed on each of the two opposing side surfaces.

* * * * *